US009272884B2

(12) United States Patent
Husson et al.

(10) Patent No.: US 9,272,884 B2
(45) Date of Patent: Mar. 1, 2016

(54) TELESCOPIC BOOM FOR MATERIAL HANDLING VEHICLE

(75) Inventors: Geoffroy Husson, Beauvais (FR); Pierre Dupire, Doulers (FR)

(73) Assignee: AGCO SA, Beauvais (FR)

( * ) Notice: Subject to any disclaimer, the term of this patent is extended or adjusted under 35 U.S.C. 154(b) by 866 days.

(21) Appl. No.: 13/522,064

(22) PCT Filed: Jan. 5, 2011

(86) PCT No.: PCT/EP2011/050111

§ 371 (c)(1),
(2), (4) Date: Jul. 13, 2012

(87) PCT Pub. No.: WO2011/086022

PCT Pub. Date: Jul. 21, 2011

(65) Prior Publication Data

US 2012/0301259 A1 Nov. 29, 2012

(30) Foreign Application Priority Data

Jan. 14, 2010 (GB) ..... 1000536.1

(51) Int. Cl.
*E02F 9/14* (2006.01)
*B66C 23/70* (2006.01)
(Continued)

(52) U.S. Cl.
CPC ..... *B66C 23/708* (2013.01); *B66C 23/701* (2013.01); *B66C 23/706* (2013.01); *B66C 23/707* (2013.01); *E02F 3/286* (2013.01); *E02F 3/306* (2013.01)

(58) Field of Classification Search
CPC .. B66C 23/701; B66C 23/706; B66C 23/707; B66C 23/708; B66F 9/0655; E02F 3/286; E02F 3/306
USPC ..... 414/722, 727, 728
See application file for complete search history.

(56) References Cited

U.S. PATENT DOCUMENTS 3,727,359 A * 4/1973 Vonck ..... 52/121
3,770,138 A * 11/1973 Chalupsky et al. ..... 212/349
(Continued)

FOREIGN PATENT DOCUMENTS

CA 2226618 A1 7/1999
FR 2133671 A1 12/1972
GB 1481101 A 7/1973

OTHER PUBLICATIONS

International Search Report for International Application No. PCT/EP2011/050111 Dated Apr. 6, 2011.
(Continued)

*Primary Examiner* — Scott Lowe

(57) ABSTRACT

A telescopic boom (10) suitable for a material handling vehicle is provided. The boom comprises two telescopic sections. One end (12*a*) of an inner tube element (12) is telescopically slideable in one end (14*a*) of an outer tube element (14) so that a majority length of the inner tube element can be received therein. An intermediate element (16) is also provided, a first end (16*a*) of which resides within, and is slideable in, the outer tube element (14). A second end (16*b*) of the intermediate element is telescopically slideable in the end (12*a*) of the inner tube element (12) that resides inside the outer tube element. A first stop (20) serves to limit withdrawal of the first end (16*a*) of the intermediate element from the outer tube element (14), whilst a second stop (18) serves to limit withdrawal of the second end (16*b*) of the intermediate element from the inner tube element (12). The provision of the intermediate element (16) allows a reduced overlap between the telescopic sections (12,14) thus increased reach.

15 Claims, 5 Drawing Sheets

(51) Int. Cl.
*E02F 3/28* (2006.01)
*E02F 3/30* (2006.01)

(56) References Cited

U.S. PATENT DOCUMENTS 4,585,132 A * 4/1986 Rathe et al. ..... 212/349
5,584,645 A * 12/1996 Kaspar ..... 414/728
2003/0071004 A1 4/2003 Higgins
2006/0180563 A1 * 8/2006 Knight ..... 212/299

OTHER PUBLICATIONS

UK Search Report for UK Application No. GB1000536.1 Dtaed May 7, 2010.

* cited by examiner

10

F
12
14a
16b
15
16
17
14
12a
16a
18
20
22

TELESCOPIC BOOM FOR MATERIAL HANDLING VEHICLE

The invention relates to telescopic booms which have at least two telescopic elements. In particularly but not exclusively so, the invention relates to telescopic booms which are suitable for use on material handling vehicles such as utility diggers and agricultural telehandlers.

The use of telescopic booms on utility vehicles has been prevalent for many years. In most cases a single boom (or arm) comprises two or more nested elements which telescope with respect to one another allowing the single arm to extend in length. This allows such utility vehicles to increase their reach without the need for a cumbersome long arm. Instead the telescopic nature of the boom allows the arm to collapse to a manageable length thus enabling easy transport and improved stability.

Significant loads are often placed upon the telescopic booms and, when pitched at an angle to the vertical, the load indices a force with a bending component which can place considerable stress on weak spots of the boom. In order to maintain strength in the overall structure, a significant minimum overlap between the telescope elements is provided. In other words each inner telescopic element is only permitted to withdraw from its surrounding element by no more than, say, 50% of its total length. This requirement places significant constraints on the maximum achievable reach for a telescopic boom with a given number of telescopic elements.

The reach can, of course, be increased by a) increasing the overall length of the telescopic boom elements and/or b) increasing the number of nested telescopic elements. The former carries the disadvantage that the overall assembly is more cumbersome to transport and does not collapse down to a short length whereas the latter option suffers from increased complexity in construction thus making the overall assembly more expensive and prone to failure.

It is an object of the invention to provide a telescopic boom with improved reach which does not require longer, nor indeed more, telescopic elements.

In accordance with the invention there is provided a telescopic boom for a material handling vehicle, the boom comprising an inner tube element, one end of which is telescopically slideable in one end of an outer tube element so that a majority length of the inner tube element can be received therein, and an intermediate element, a first end of which resides within, and is slideable in, the outer tube element and a second end, opposite the first end, being telescopically slideable in the end of the inner tube element that resides inside the outer tube element, a first stop to limit withdrawal of the first end of the intermediate element from the outer tube element, and a second stop to limit withdrawal of the second end of the intermediate element from the inner tube element. The intermediate element provides increased support between the outer and inner tube elements which allows for reduced overlap therebetween and thus providing increased boom extension. Therefore, the reach of a twin element telescopic boom is improved without increasing the overall length thereof and without the need for further (externally exposed) telescopic elements.

By placing the intermediate element inside the inner tube element any external bending force is transmitted via the intermediate element from the inside of the inner tube element to the inside of the outer tube element.

In a preferred arrangement the first stop is fixed to the inside of the outer tube element and the intermediate element comprises first limitation means which acts upon the first stop at maximum permitted withdrawal, the first stop being disposed clear of the inner tube element when slid into the outer tube element. The first stop restricts the extent to which the intermediate element can slide from the outer tube element without interfering with the nesting of the inner tube element inside the outer tube element. The first limitation means may comprise a plunger having a wider diameter than the inner tube element, the plunger being affixed to the first end of the intermediate element. Therefore, upon extension of the boom, withdrawal of the intermediate element is restricted by the plunger acting upon the first stop.

In an alternative arrangement the first stop may be fixed to the intermediate element and first limitation means may be associated with the outer tube element. For example, the first end of the intermediate element may have fixed thereto a collar which surrounds concentrically part of the intermediate element and has a diameter sufficient to accept the end of the inner tube element which resides inside the outer tube element. In this case the collar may act upon an end wall of the outer tube element to restrict withdrawal of the intermediate element therefrom. In any case, the first stop and the first limitation means act in conjunction with one another to limit withdrawal of the intermediate element from the outer tube element.

The second stop may be fixed to the intermediate element and the inner tube element may have associated therewith second limitation means which acts upon the second stop at maximum permitted withdrawal. The second stop may simply comprise a protrusion fixed to the intermediate element which acts upon the end wall of the inner tube element which resides inside the outer tube element.

Advantageously, as described above the intermediate element provides increased support between the inner and outer tube elements to counter bending forces placed thereupon. In a preferred arrangement the first stop is positioned so as to allow at least 40% of the length of the intermediate element to be withdrawn from the outer tube element. Preferably further still the second stop is positioned to allow at least 40% of the length of the intermediate element to be withdrawn from the inner tube element. In both cases the invention permits increased extension of the overall telescopic boom thus improving the reach thereof. For example, the stops and limitation means may be arranged to permit at least 90% of the length of the inner tube element to be withdrawn from the outer tube element.

The telescopic boom in accordance with the invention is preferably provided with telescopic elements formed of rectangular hollow structural sections. However it will be appreciated that other materials may be used such as circular hollow structural sections. Moreover, the outer and inner tube elements may be formed of a different shaped section to that of the intermediate element.

The telescopic boom in accordance with the invention may be employed in a telescopic boom assembly which also includes a hydraulic cylinder having one end fixed relative to the outer tube element and the other end fixed relative to the inner tube element, the cylinder serving to extend and retract the telescopic boom. The intermediate element does not form a separate telescopic element and serves simply to provide support between the inner and outer tube elements. Therefore the inventive telescopic boom can be employed in known assemblies and, as such, the hydraulic cylinders employed to control extension thereof can simply be connected between the two telescopic elements. In a preferred arrangement the hydraulic cylinder is located inside the telescopic boom.

Although not limited to such the telescopic boom in accordance with the invention is particularly advantageous when applied on material handling vehicles such as agricultural telehandlers and plant machinery. In this case one end of the telescopic boom is fixed relative to the chassis whilst the other end of the telescopic boom is fixed relative to a material handling attachment such as a grain bucket or manure fork.

Further advantages of the invention will become apparent from reading the following description of specific embodiments with reference to the appended drawings in which:

FIGS. 1(*a*), 1(*b*), 1(*c*) and 1(*d*) schematically show a telescopic boom in accordance with one embodiment of the invention at different stages of extension and retraction;

Figures 1A, 1B, 1C, 1D:
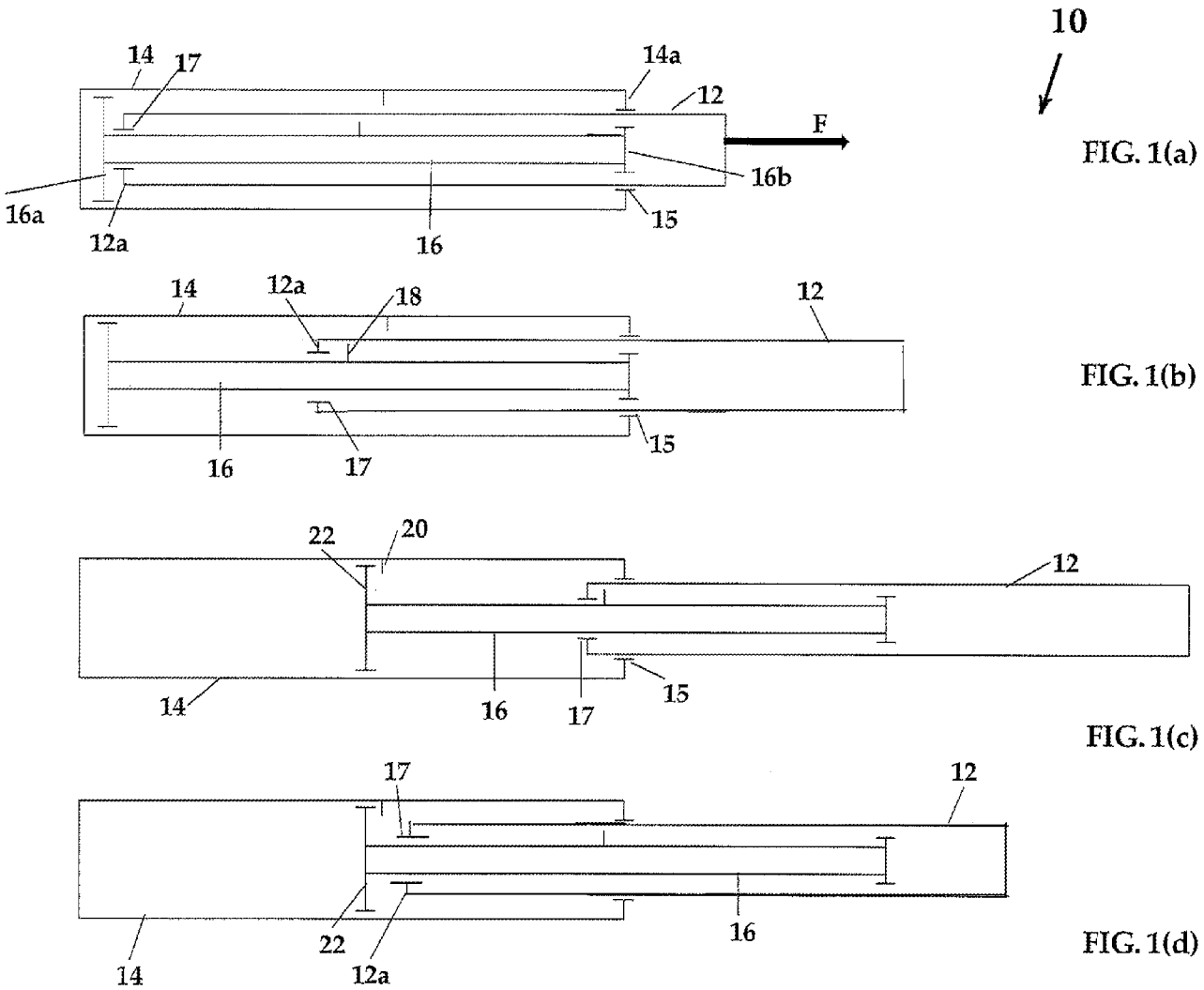

Before describing the constructional details of a specific embodiment the general principle underlying the operation of a telescopic boom in accordance with the invention will be described with reference to FIGS. 1*a* to *d*. The telescopic boom 10 shown in FIG. 1 comprises an inner tube element 12 and an outer tube element 14. A first end 12*a* of the inner tube element 12 is telescopically slideable in a first end 14*a* of the outer tube element so that a majority length of the inner tube element 12 can be received therein as shown in FIG. 1*a*. The inner tube element 12 slides with respect to the outer tube element 14 inside circumferential sliding bearing 15 which is positioned in an end wall at the first end 14*a* of the outer tube element 14. Represented by arrow F in FIG. 1 an external force is applied, typically by a hydraulic cylinder, to withdraw the inner tube element 12 from the outer tube element 14 in a telescoping manner.

In accordance with the invention an intermediate element 16 is provided to strengthen the connection between the inner tube element 12 and the outer tube element 14 when extended. The intermediate element 16 is elongate in shape and a first end 16*a* of which resides within, and is slideable in, the outer tube element 14. A second end 16*b* of the intermediate element 16 is telescopically slideable in the first end 12*a* of the inner tube element 12. A circumferential sliding bearing 17 is provided in the end wall of first end 12*a* of inner tube member 12 to permit sliding of the intermediate member 16 and to support a load upon extension of the boom 10.

At minimum extension (or full retraction) the majority of the length of inner tube element 12 is stowed inside outer tube element 14 as shown in FIG. 1*a*. As the external force is applied to withdraw inner tube element 12 from outer tube element 14 (thus extending the overall boom 10), the inner tube element 12 slides along sliding bearing 15 whilst the intermediate element 16 slides through sliding bearing 17. In effect the intermediate element 16 remains stationary with respect to the outer tube element 14 whilst the inner tube element 12 withdraws from the outer tube element 14. This extension continues until an inner stop 18, disposed on the intermediate element 16, comes in to contact with end wall 12*a* of inner tube element 12 as shown in FIG. 1*b*.

A continuation of the applied external extending force F causes the intermediate element 16 to be withdrawn from the outer tube element 14. An outer stop 20 disposed on the inside of the outer tube element 14 eventually comes into contact with a plunger 22 which is fixed to the first end 16*a* of the intermediate element 16 (FIG. 1*c*). At this stage over 90% of the length of the inner tube element 12 is withdrawn from the outer tube element 14. In accordance with the invention the intermediate element 16 provides structural support against bending forces exerted upon the telescopic boom 10.

A reverse action of the extending force F causes the inner tube member 12 to retract into the outer tube element 14. As shown in FIG. 1*d* upon retraction from the full extension (shown in FIG. 1*c*) the inner tube member 12 slides relative to both the outer tube element 14 and intermediate element 16 utilizing sliding bearings 15 and 17. When the first end wall 12*a* of inner tube element 12 comes into contact with plunger 22 the intermediate element 16 is also carried into the outer tube element 14.

It should be appreciated that the above described operation is only an example and the floating nature of the intermediate element 16 means that, at any intermediate extension, the intermediate element is free to slide within the limitations of inner stop 18 and outer stop 20. The sliding bearing offering the lowest frictional resistance will typically be the first to slide thus determining the movement of the intermediate member 16.

Figure 2:
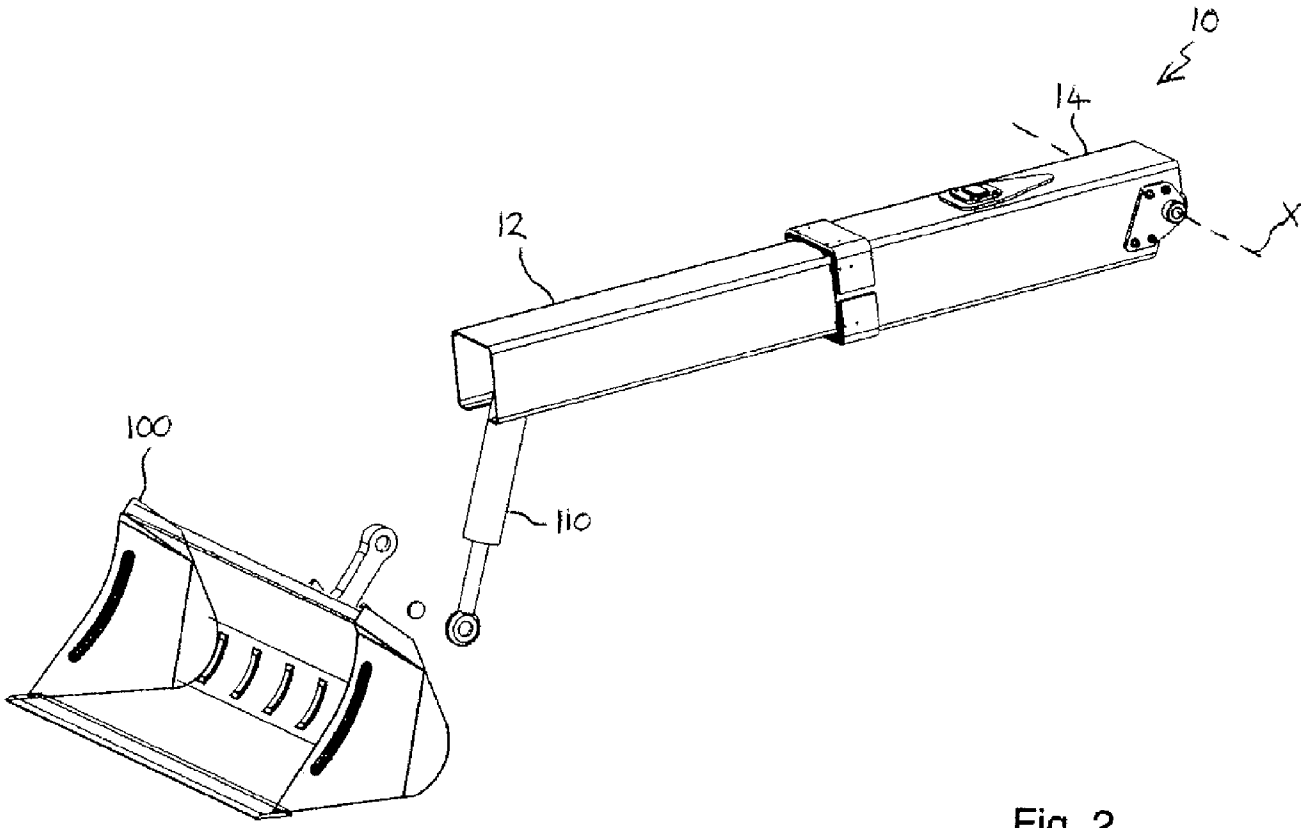
FIG. 2 is a perspective view of a telescopic boom in accordance with one embodiment of the invention showing also a grain bucket.

Turning to the specific construction of an embodiment of the invention FIGS. 2 to 5 show a telescopic boom 10 having an inner tube element 12 and outer tube element 14. The telescopic boom 10 lends itself particularly well to material handling vehicles and, as such, FIG. 2 shows a grain bucket 100 for attachment to one end of the telescopic boom 10 in an example application. Staying with FIG. 2 the end of telescopic boom 10 remote the attachment 100 is pivotally attached to the chassis (not shown) of a material handling vehicle so as to pivot around axis X. It should be appreciated that the inventive telescopic boom is not limited to application and material handling vehicles and may be used in multitude of other applications. Although not shown in FIG. 2 a hydraulic lift cylinder may be connected between the outer tube element 14 and the chassis of the associated vehicle so as to control lifting and lowering of the telescopic boom 10 around axis X. At the other end of telescopic boom 10 the chosen attachment 100 is secured to inner tube element 12 via a linkage assembly 110 as illustrated in simplified form in FIG. 2.

Figure 3:
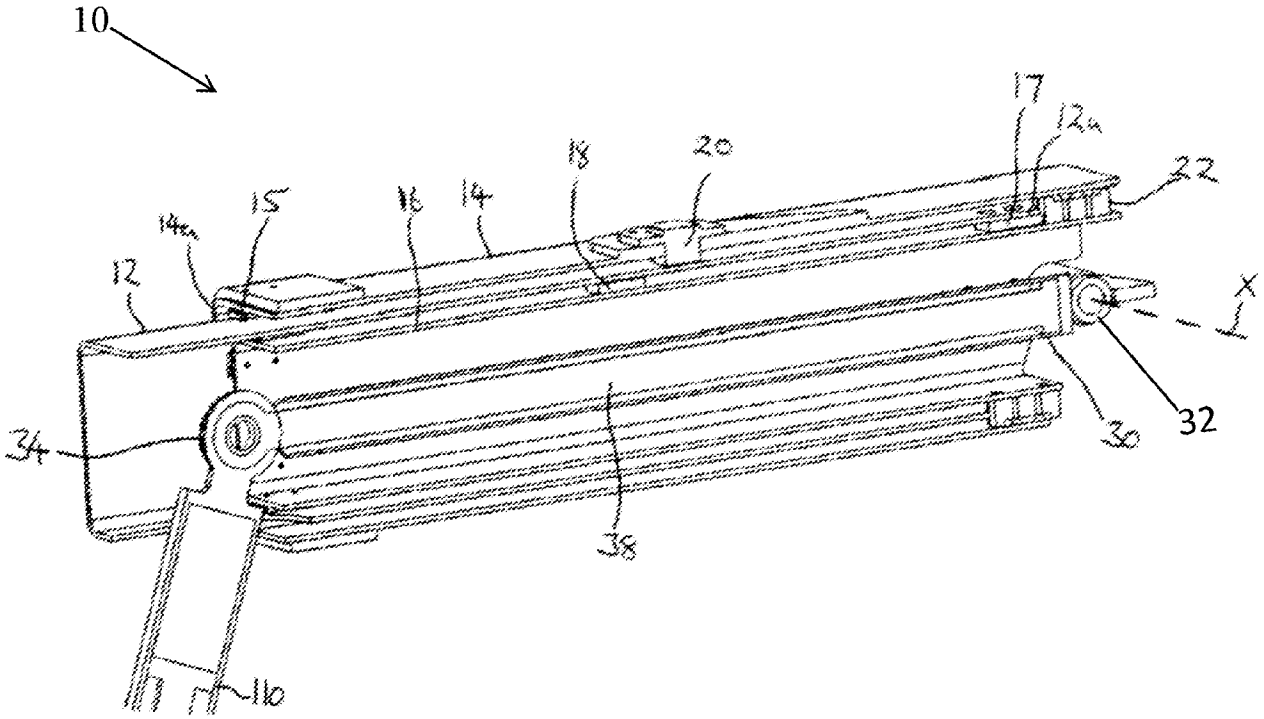
FIG. 3 is a perspective view of a central vertical section taken through the telescopic boom shown in FIG. 2 in a fully retracted position.

Turning to the construction of telescopic boom 10 FIG. 3 shows a vertical section therethrough when the fully retracted position. The inner tube element 12 and outer tube element 14 are constructed from rectangular hollow structural sections formed of steel or other similar material. Likewise the intermediate element 16 is formed of length of rectangular hollow structural section.

Sliding bearing 15 provides sliding engagement between the outside of inner tube element 12 and the inside of outer tube element 14 and is located near the end wall 14*a* of outer tube element 14. Likewise, sliding bearing 17 is provided at a first end 12*a* of inner tube element 12 to allow the relative sliding motion of intermediate element 16.

A hydraulic cylinder 30 is connected between first pivotal joint 32 centred on axis X and second pivotal joint 34 fixed relative to inner tube element 12. The hydraulic cylinder 30 resides wholly within the telescopic boom 10 out of sight. The application of pressurised fluid to the cylinder 30 is controlled via attached pipes (not shown) and which serves to extend and retract a piston rod 38 inside the hydraulic cylinder 30. This creates the desired force to slide the inner tube element 12 relative to the outer tube element 14.

Figure 4:
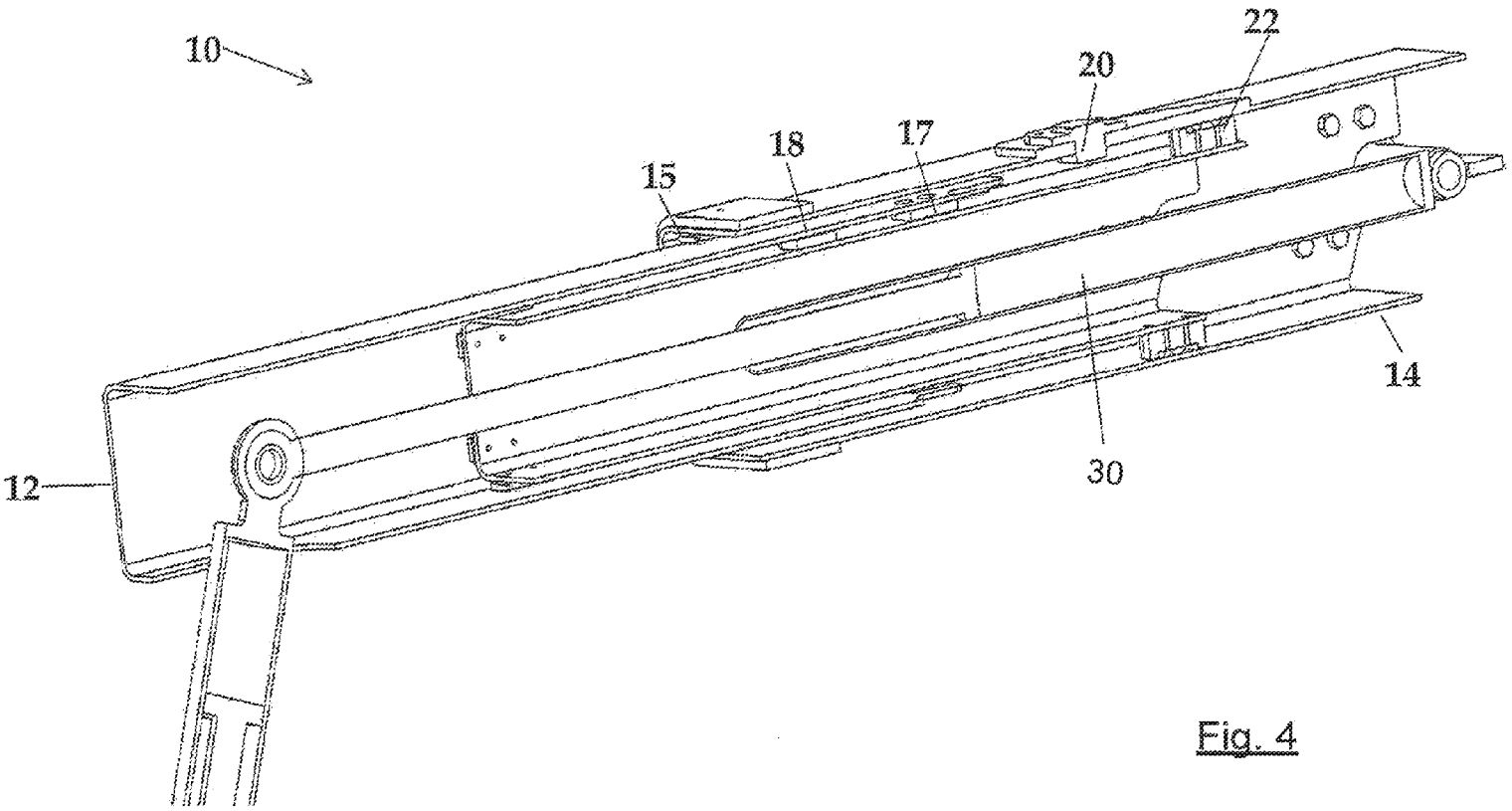
FIG. 4 is a perspective view of the vertical cross section shown in FIG. 3 showing the telescopic boom in a partially extended position.
Figure 5:
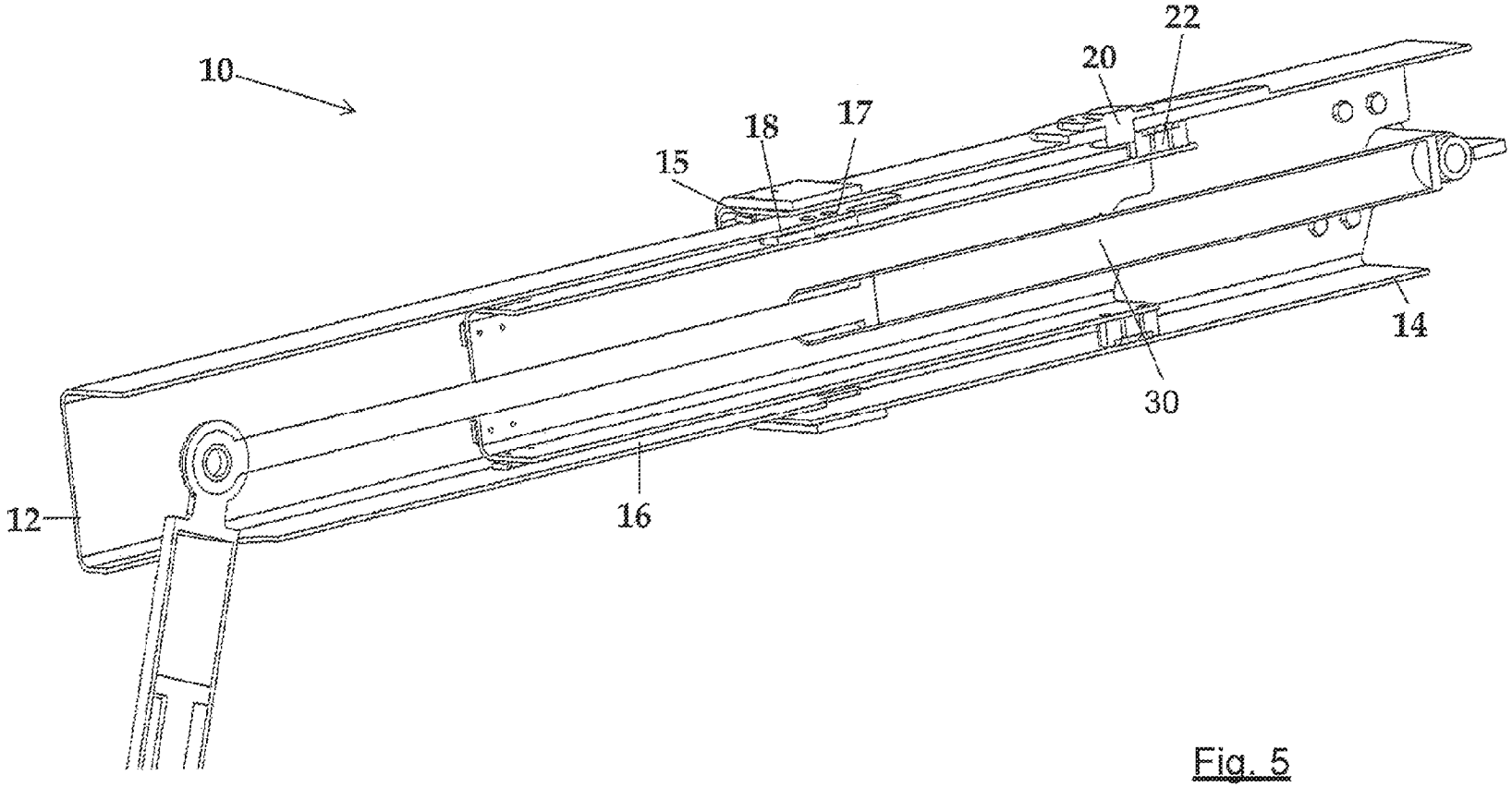
FIG. 5 shows a perspective view of the cross section of FIG. 3 showing the telescopic boom in a fully extended position.

Following the principles described above the inner tube element 12 extends from a fully retracted position as shown in FIG. 3, through an intermediate position, as shown by way of example in FIG. 4, to a fully extended position as shown in FIG. 5. The intermediate element 16 slides with respect to the inner tube element 12 and the outer element 14 depending on the sliding bearing offering minimum resistance up to a point where inner stop 18 and outer stop 20 limit the sliding movement thereof.

As can be seen from FIG. 5 the inner tube element 12 is almost fully retracted from the length of outer tube element 12 whilst the intermediate element 16 provides support from the inside against bending forces upon the length of the boom 10.

Although a 'two-section' telescopic boom is described, the invention is equally applicable to a three- (or more) section boom. In this case, an intermediate element in accordance with the invention may be provided between the first and second tube elements whilst a conventional telescoping mechanism may exist between the second and third tube elements. Alternatively, respective intermediate elements may be associated with both overlapping connections.

In summary, there is provided a telescopic boom suitable for a material handling vehicle. The boom comprises two telescopic sections. One end of an inner tube element is telescopically slideable in one end of an outer tube element so that a majority length of the inner tube element can be received therein. An intermediate element is also provided, a first end of which resides within, and is slideable in, the outer tube element. A second end of the intermediate element is telescopically slideable in the end of the inner tube element that resides inside the outer tube element A first stop serves to limit withdrawal of the first end of the intermediate element from the outer tube element, whilst a second stop serves to limit withdrawal of the second end of the intermediate element from the inner tube element. The provision of the intermediate element allows a reduced overlap between the telescopic sections thus increased reach.

The invention claimed is:

1. A telescopic boom assembly comprising a telescopic boom for a material handling vehicle, the boom comprising an inner tube element, one end of which is telescopically slideable in one end of an outer tube element so that a majority length of the inner tube element can be received therein, and an intermediate element, a first end of which resides within, and is slideable in, the outer tube element and a second end, opposite the first end, being telescopically slideable in the end of the inner tube element that resides inside the outer tube element, a first stop to limit withdrawal of the first end of the intermediate element from the outer tube element, and a second stop to limit withdrawal of the second end of the intermediate element from the inner tube element, the telescopic boom assembly further comprising a hydraulic cylinder having one end fixed relative to the outer tube element and the other end fixed relative to the inner tube element, the cylinder serving to extend and retract the telescopic boom, wherein the intermediate element provides increased structural support against bending forces between the outer and inner tube elements, allowing for reduced overlap between the outer and inner tube elements providing increased boom extension.

2. The telescopic boom assembly according to claim 1, wherein the first stop is fixed to the inside of the outer tube element and the intermediate element comprises first limitation means which acts upon the first stop at maximum permitted withdrawal, the first stop being disposed clear of the inner tube element when slid into the outer tube element.

3. The telescopic boom assembly according to claim 2, wherein the first limitation means comprises a plunger having a wider diameter than the inner tube element, the plunger affixed to the first end of the intermediate element.

4. The telescopic boom assembly according to claim 1, wherein the second stop is fixed to the intermediate element and the inner tube element comprises second limitation means which acts upon the second stop at maximum permitted withdrawal.

5. The telescopic boom assembly according to claim 4, wherein the second limitation means is provided by an end wall of the inner tube element that resides inside the outer tube element.

6. The telescopic boom assembly according to claim 1, wherein the first stop allows at least forty percent of the length of the intermediate element to be withdrawn from the outer tube element.

7. The telescopic boom assembly according to claim 1, wherein the second stop allows at least forty percent of the length of the intermediate element to be withdrawn from the inner tube element.

8. The telescopic boom assembly according to claim 1, wherein at least ninety percent of the length of the inner tube element can be withdrawn from the outer tube element.

9. The telescopic boom assembly according to claim 1, wherein at least one of the outer tube element, inner tube element and intermediate element comprises a rectangular hollow structural section.

10. The telescopic boom assembly according to claim 1, wherein the hydraulic cylinder is not directly connected to the intermediate element.

11. The telescopic boom assembly according to claim 1, wherein the hydraulic cylinder has one end connected to the outer tube element and/or the other end connected to the inner tube element.

12. The telescopic boom assembly according to claim 1, wherein the hydraulic cylinder is located inside the telescopic boom.

13. The material handling vehicle comprising the telescopic boom assembly according to claim 1, wherein one end of the telescopic boom is fixed relative to a chassis, and the other end of the telescopic boom is fixed relative to a material handling attachment.

14. A telescopic boom for a material handling vehicle, the boom comprising an inner tube element, one end of which is telescopically slideable in one end of an outer tube element so that a majority length of the inner tube element can be received therein, and an intermediate element, a first end of which resides within, and is slideable in, the outer tube element and a second end, opposite the first end, being telescopically slideable in the end of the inner tube element that resides inside the outer tube element, a first stop to limit withdrawal of the first end of the intermediate element from the outer tube element, and a second stop to limit withdrawal of the second end of the intermediate element from the inner tube element, wherein the first stop is fixed to the inside of the outer tube element and the intermediate element comprises first limitation means which acts upon the first stop at maximum permitted withdrawal, the first stop being disposed clear of the inner tube element when slid into the outer tube element, wherein the first limitation means comprises a plunger having a wider diameter than the inner tube element, the plunger affixed to the first end of the intermediate element.

15. A telescopic boom for a material handling vehicle, the boom comprising an inner tube element, one end of which is telescopically slideable in one end of an outer tube element so that a majority length of the inner tube element can be received therein, and an intermediate element, a first end of which resides within, and is slideable in, the outer tube element and a second end, opposite the first end, being telescopically slideable in the end of the inner tube element that resides inside the outer tube element, a first stop to limit withdrawal of the first end of the intermediate element from the outer tube element, and a second stop to limit withdrawal of the second end of the intermediate element from the inner tube element, wherein the second stop is fixed to the intermediate element and the inner tube element comprises a second limitation means which acts upon the second stop at maximum permitted withdrawal, wherein the second limitation means is provided by an end wall of the inner tube element that resides inside the outer tube element.

* * * * *